United States Patent [19]

Haegermann

[11] 4,212,243

[45] Jul. 15, 1980

[54] INSTALLATION FOR THE STAMPING OF ADVANCING ROLLING STOCK IN ROLLING MILLS AND CONTINUOUS CASTING PLANTS

[76] Inventor: Helmut Haegermann, am Altenhof 21, 4030 Ratingen 6/Hosel, Fed. Rep. of Germany

[21] Appl. No.: 903,960

[22] Filed: May 8, 1978

[30] Foreign Application Priority Data

May 7, 1977 [DE] Fed. Rep. of Germany ..... 2720676

[51] Int. Cl.[2] ..... B44B 5/00; B41F 17/00

[52] U.S. Cl. ..... 101/4; 92/151

[58] Field of Search ..... 101/4, 3 R; 92/66, 151, 92/152

[56] References Cited

U.S. PATENT DOCUMENTS

| | | | |
|---|---|---|---|
| 2,483,239 | 9/1949 | Sharpe | 92/66 X |
| 2,994,264 | 8/1961 | Haver | 101/4 UX |
| 3,500,744 | 3/1970 | Lewis | 92/151 X |

FOREIGN PATENT DOCUMENTS

| | | | |
|---|---|---|---|
| 2320796 | 11/1974 | Fed. Rep. of Germany | 101/4 |

*Primary Examiner*—Clifford D. Crowder

*Attorney, Agent, or Firm*—Schwartz, Jeffery, Schwaab, Mack, Blumenthal & Koch

[57] ABSTRACT

The invention comprises an installation for continuously stamping advancing rolling stock and the like. A pair of cylinders are positioned having their bottom ends facing each other and their top ends extending in substantially opposite directions. Each of the cylinders has a piston movable therein and a piston rod connected thereto. The piston rod of the first of the cylinders is connected to a stamping pendulum, having a stamping die thereon; whereas, the piston rod of the second cylinders is connected to a stationary point. The first cylinder has at the top end thereof a stationary intermediate piece with a passage for the piston rod provided therein. The passage has an internal diameter exceeding the external diameter of the piston rod and a projection located on the piston at the side of the intermediate piece. The projection follows the motion of the piston and sealingly engages the passage during the extension of the piston.

2 Claims, 4 Drawing Figures

INSTALLATION FOR THE STAMPING OF ADVANCING ROLLING STOCK IN ROLLING MILLS AND CONTINUOUS CASTING PLANTS

BACKGROUND OF THE INVENTION

The invention relates to an installation for the stamping of advancing rolling stock, particularly on a rolling table, such as slabs, billets, finished sections, and the like. Installations of the type described are used in rolling mills and in continuous casting installations wherein a stamping die is suspended rotatably in the direction of the advance of the rolling stock by means of a pendulum arm. The stamping die is rotated by the pendulum arm out of the path of the rolling stock when impacted on the stock in the course of the stamping action with the aid of a force, preferably pneumatic, actuated by a switch responding as a function of the motion of the die and the advance of the rolling stock. The force acts on a stationary point of the stand or frame of the installation and on a point of attack acting upon the stamping die and located opposite the stationary point. A cylinder with a piston and piston rod located within the cylinder and the stamping die are maintained in a suspended position until released for a return swing into the path of advance of the rolling stock by a switching element responding as a function of the distance of the rolling stock from the stamping location.

PRIOR ART

Such an installation is displayed and described in German Application No. 23 20 796 of Nov. 21, 1974. In this installation the grinding of the stamping die over the rolling stock is avoided. Such grinding occurs when the pendulum arm with the stamping die is rotated out of the path of the advancing rolling stock by the stock itself subsequent to the impact of the stock on the stamping die. The pendulum arm with the stamping die thereon is returned to its initial vertical position in this case by the weight of the stamping die. Such installations have the additional disadvantage that the marks of the stamping die are shifted radially with respect to the suspension of the pendulum arm on the front surface of the rolling stock during the rotation of the arm out of the path of the stock. This has a detrimental effect on the markings and leads to wear and damage. Operations at high velocities should hardly be possible. These disadvantages are also eliminated in the installation of German Application No. 23 20 796 because in this installation the rolling stock and the stamping head, together with the markings to be imparted, are relieved of the stress caused by the necessary rotation of the stamping die from the path of the advancing rolling stock subsequent to the impact of the rolling stock against the stamping die for the purpose of marking the stock. Similarly, no particularly onerous stresses are generated by the return swing of the stamping die into its working position, and the utilization of the live force for the advance and stamping of the rolling stock is assured, provided that the velocity of the advance remains within intermediate limits.

With increasing working velocities or high advance velocities of the rolling stock, i.e., advance velocities to approximately 4.00 m/sec., very high accelerations are generated in the pneumatic cylinder supplying the additional force for the rotation which leads to considerable impact and shock, and thus to high stresses in the parts. This may result in fractures and the unsettling of the entire installation. There occurs further a generation of noise which exceeds the permissible noise level.

Operation with frictional force of the installation, i.e., working with constant application of frictional force is not possible at higher velocities, because from the instant of the impact of the rolling stock against the stamping die to the point in time when the markings or numerals stamped onto the rolling stock must be released by the stamping die, a maximum period of time of only 10 μsec. is available, if the stamping wheel is not to grind on the stock with the markings. This short period of time is also the reason why, at high stamping velocities, the stamping wheels briefly scan over the rolling stock, thus suffering severe wear.

A great disadvantage of the known installation of German Application No. 23 20 796 consists of the fact that it is not suitable for working at low velocities, i.e., velocities of 1.5 m/sec. and less because the rolling stock advancing against the stamping die carries no kinetic force sufficient for stamping.

SUMMARY AND OBJECTS

The essential object of the invention is to eliminate the disadvantages of the known installation and to provide an installation capable of operating both at low advance velocities of less than 1.5 m/sec., such as encountered for example in continuous casting; at intermediate advance velocities of the rolling stock to 2.5 m/sec.; and at high advance velocities to 4.00 m/sec.

The invention attains its object by providing a pair of cylinders having their bottom ends facing each other and having their other ends pointing in opposite directions, each with a piston impactable on both sides and mounted on a piston rod. One piston rod of one cylinder is connected positively to a stationary point on the frame or stand of the installation, and the other piston rod is connected to a point of attack on the stamping pendulum.

In this manner, the danger of harmful impacts and shocks is eliminated when working with high velocities of the rolling stock. It is also assured that the noise level of the operation will not exceed the permissible limit. This is because the pendulum rotates in both directions exclusively under closed force contact, with the force as a pneumatic force possessing a certain internal elasticity or yielding capability, without this property having a detrimental effect on the closed force contact.

There is also the further possibility to use the installation for the stamping of rolling stock advancing at lower velocities, from 1.5 m/sec. downward, by having one cylinder traveling with a kinetic force increasing the kinetic force of the stamping die rotating back into the path of the advancing rolling stock. This results in the reinforcement of the impact of the stamping die upon the rolling stock by enhancing the kinetic force reduced by the lower velocity of the advancing rolling stock, i.e., by equalizing the reduction.

Conveniently, the two cylinders are connected at their bottom ends and are located in the same axis.

The cylinder containing the piston mounted on the piston rod acting upon the stamping pendulum, contains at its side facing the end of the rod, between the piston and the end of the rod of the cylinder, a stationary intermediate piece having a passage for the piston rod with an internal diameter exceeding the external diameter of said piston rod, with a projection of the piston on the side of the intermediate piece fitting sealingly into said passage during the outward travel of the piston.

This arrangement makes it possible, so that in the extended state of the piston, i.e., of the piston rod, a reduced pressure acting on the piston at the side of the bottom end of the cylinder in opposition to the normal pressure acting on one piston on the rod side of the cylinder, maintains the piston rod in the extended position. Thus, when the piston begins to retract under the effect of a force exerted by the stamping pendulum on the end of the piston rod extending from the cylinder, the projection is withdrawn from the passage in the intermediate piece and from the radial seal located in said passage. This results in the entire surface of the piston facing the end of the rod being exposed to the standard pressure, and the piston returns abruptly with the piston rod into the cylinder, so that the stamping die is rotated instantaneously or with only a slight hesitation from the path of the rolling stock upon being struck by the latter.

When the rolling stock advances with a velocity in excess of 1.5 m/sec., the mode of operation of the installation is such that the piston in the cylinder facing the pendulum arm is placed under standard pressure at the rod end of the cylinder, and under reduced pressure at the other end. The impact of the advancing rolling stock against the stamping die on the pendulum arm initiates a rotation of the stamping pendulum in the direction of the advance of the rolling stock, whereby the resulting displacement of the piston rod with the piston in the cylinder on the side of the stamping arm moves the projection of the piston out of the intermediate piece and due to the admission of air at standard pressure through the passage resulting from said movement, the entire surface on the rod side of the piston is acted upon, leading to the abrupt return of the piston with its piston rod while displacing the reduced pressure on the other side of said piston, which in the cylinder facing in the other direction places the piston under standard pressure on the side of the rod and under reduced pressure on the bottom side. This causes the piston to return into the cylinder while taking the other cylinder with it. Thus, the stamping die is rotated out of the path of the advancing rolling stock. Thereafter, the action of the standard pressure on the rod side of the first piston is eliminated, and the piston is displaced by the action of reduced pressure on the bottom side with the accompanying reduction of the impactable area of the surface of the piston on the rod side to a smaller annular surface, due to the sealing entrance of the projection of the piston into the intermediate piece. In the cylinder the bottom side of the piston contained therein is impacted by standard pressure causing the second piston rod to extend while the rod side of the piston is deaerated.

If the rolling stock advances at a low velocity, i.e., at a velocity lower than 1.5 m/sec., the mode of operation is altered to the extent that in the path of the advancing rolling stock a switching element is provided at a suitable location to actuate the conduct of standard pressure to the bottom end of the piston in the second cylinder, the piston being connected by means of the piston rod, when with the aid of the other cylinder the stamping die has completed part of its return into the path of the rolling stock so that the kinetic force of the pendulum during the return swing is increased, and the impact of the stamping die on the rolling stock enhanced.

This strengthens the impact and eliminates the reduction of the impact force required for the marking due to the slow advance of the rolling stock.

BRIEF DESCRIPTION OF THE DRAWINGS

The above and other objects of the invention will best be understood from the following description and accompanying drawings, the drawings showing schematically an example of the embodiment of the invention and wherein.

DETAILED DESCRIPTION OF THE INVENTION

Figure 1:
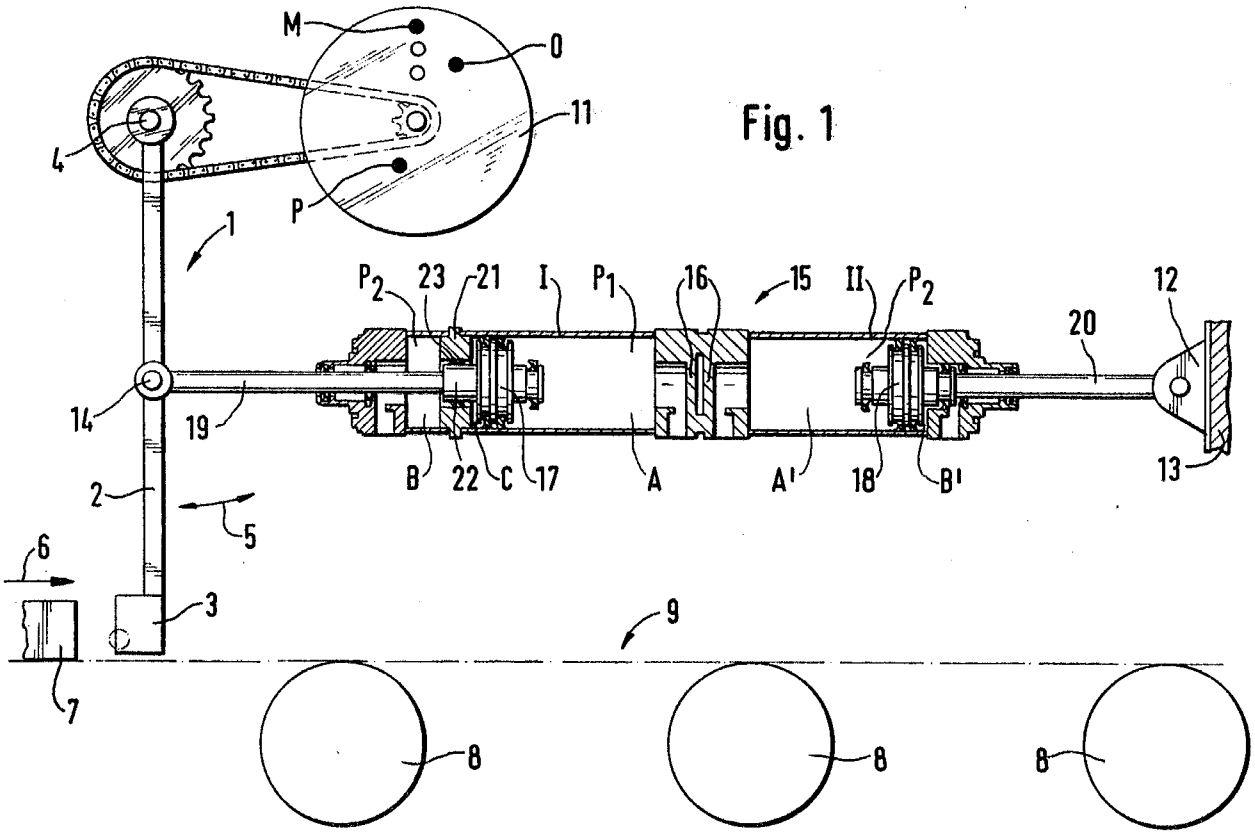
FIG. 1 shows a longitudinal view in section of the installation in the standby position for the stamping of rolling stock advancing in the rolling train at a velocity in excess of 1.5 m/sec.

The graphical representation of the drawings is restricted to the parts necessary for the understanding of the invention.

The installation consists essentially of a stamping tool suspended in the manner of a pendulum, designated in its entirety by 1, and comprising a stamping arm 2 with a stamping die 3 thereon. The stamping or pendulum arm 2 is suspended on a shaft 4 and is rotatable or swingable together with the shaft. The stamping die 3 in FIG. 1, with the pendulum arm in the vertical position, is in the path of the rolling stock, which continuously advances on a rolling train, designated in its entirety by 9, by means of a plurality of rolls 8. The advance is illustrated by an arrow 6. The pendulum arm 2 may be rotated in the direction of the dual arrow 5 in the axis of the advance of the rolling stock 7, indicated by the arrow 6, from its vertical position (FIG. 1) into a tilted position (FIG. 3) which allows the passage of the rolling stock, and back from the tilted position to the vertical position.

The installation is equipped with a pulse generator disk 11 which triggers control pulses as a function of the pendulum movement of the pendulum arm 2. The pulses are raised at the locations designated by M, O and P. In the example of embodiment shown the pulse generator disk is driven by the shaft 4, for example, by means of a chain and sprocket wheels.

Between a stationary point of attack 12 on the stand of an installation 13 and a point of attack 14 on the pendulum arm 2, a device, designated in its entirety by 15, is provided to perform the movements necessary for operation.

This device consists of a pair of cylinders I and II with their bottom ends 16 facing each other and opposite ends of the cylinders facing into opposing directions. In the form of the embodiment shown the cylinders have a common axis and are united by means of their bottoms. Both cylinders contain a piston impactable on both sides. Cylinder I contains a piston 17, and cylinder II contains a piston 18. The pressurizing medium is compressed air. The piston 17 is mounted on a piston rod 19, which acts upon the pendulum arm 2 at 14. The piston 18 is mounted on a piston rod 20. The piston rod 20 is connected with its end protruding from the cylinder II with the stationary point of attack 12 on the stand 13.

The cylinder space of the cylinder I situated on the side of the bottom 16 in opposition to the piston 17 is designated by A, and the cylinder space located on the side of the end of the rod of the cylinder at the exit of the piston rod 19 is designated by B. An intermediate piece 21 is provided between the cylinder spaces A and B. The piston rod 19 extends through the intermediate piece 21. The bore of the intermediate piece has an internal diameter larger than the external diameter of the piston rod 19. The piston 17 has in its side toward the rod a centering projection 22 which engages in the bore of the intermediate piece. The intermediate piece is equipped with a radial seal 23. During a displacement of the piston 17 toward the bottom end 16, the projection 22 moves out from the bore with its seal 23 of the intermediate piece 21 so that compressed air may flow to the rod side of the piston 17 from the cylinder space B. The cylinder space on this side of the piston is designated by C.

The cylinder space of the cylinder II situated opposite the piston 18 on the side of the bottom end 16 is designated by A' and the cylinder space located at the exit end of the piston rod 20 by B'.

The mode of operation of the installation during the stamping of rolling stock advancing at a velocity in excess of 1.5 m/sec. is as follows:

In the standby position of the installation shown in FIG. 1, the piston rods 19 and 20 are extended out of the cylinders I and II. The reduced pressure $P_1$ prevails in the cylinder space A of cylinder I and the standard pressure $P_2$ in the cylinder space B of cylinder I.

The expression of standard pressure signifies a pressure of 4 to 6 atm., and reduced pressure a substantially lesser pressure of approximately 0.5 atm. The projection 22 is in the intermediate piece 21 in a sealing position. The interspace C between the piston 17 and the intermediate piece 21 is ventilated by a small bore to the environment, i.e., the outer air of the atmosphere. The force $P_2$ generated by the standard pressure $P_2$ in the cylinder space B, which acts through the annular surface surrounding the piston rod in the intermediate piece as the pressurized surface, is significantly smaller than the counter-force $P_1$ generated at the other side of the piston 17, which is exposed in its entirety to the reduced pressure. The standard pressure $P_2$ prevails in the cylinder space A' on the bottom side of the cylinder II and maintains the piston rod 20 in the extended position by acting upon the piston 18. The stamping pendulum 2 occupies a vertical position. The stamping die located upon it protrudes into the path of the advancing rolling stock 7. The pulse location M occupies the position shown in FIG. 1.

On the rolling train 8, the rolling stock 7 moves with its mass at a velocity of 2.5 m/sec. or more in the direction of the arrow 6 against the stamping die 3 on the stamping arm 2. The rolling stock impacts against the stamping die 3. As a result, the rolling stock, by its kinetic force, rotates around the axis 4, stamping die 3 and the stamping pendulum 2 from its vertical rest position.

The initiation of the rotating motion of the stamping pendulum 2 forces the piston rod 19 of the cylinder, the piston rod attacking the pendulum, into the cylinder I. The projection 22 and its seal move out of the intermediate piece 21 and allow the compressed air of the standard pressure $P_2$ to enter the cylinder space C of the cylinder I, after having traveled a short distance. With the entrance of the compressed air, the surface on the rod side of the piston 17 is fully exposed to the standard pressure $P_2$. As a result, the force generated there exceeds the counter force on the other side of the piston facing the bottom part of the cylinder and the piston 17 is thus abruptly accelerated against the reduced pressure $P_1$. The pressure $P_1$ in the cylinder space A is steadily reduced.

Figure 2:
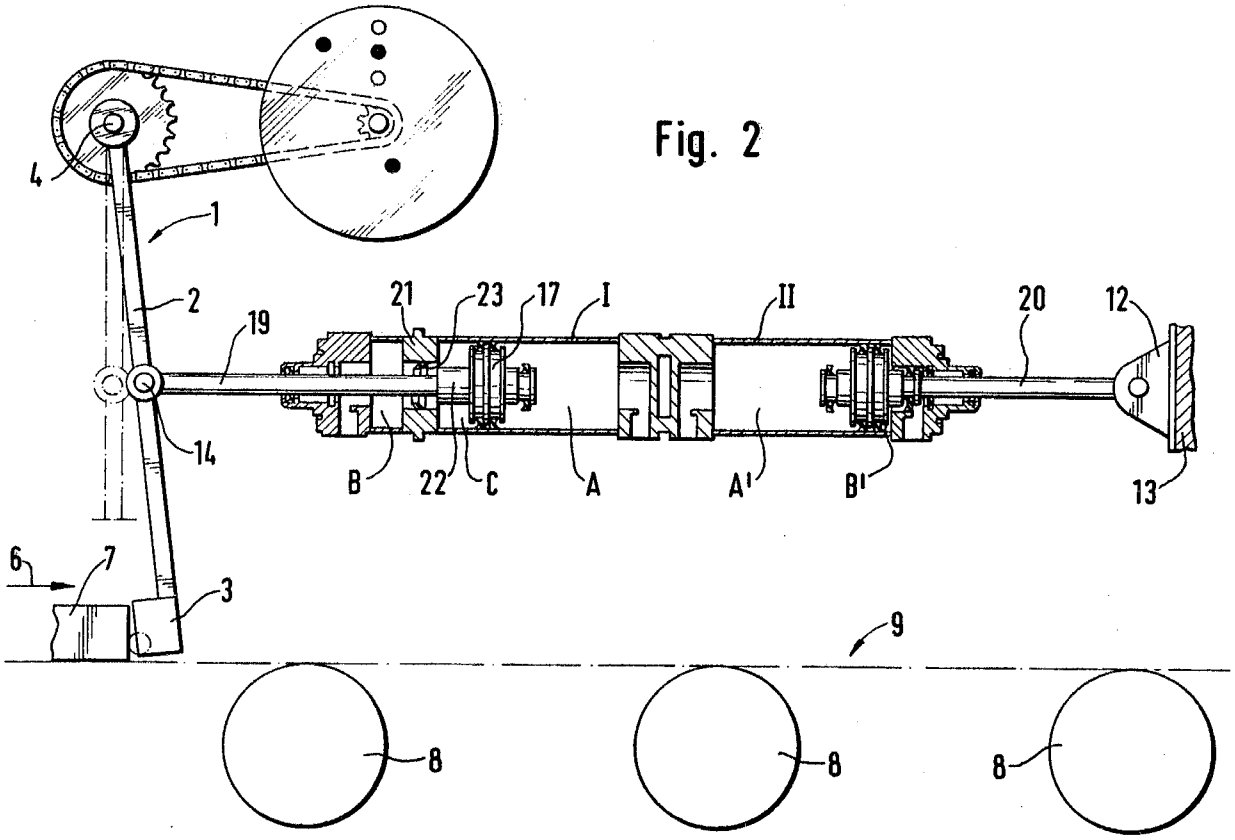
FIG. 2 shows the installation if FIG. 1 following the impact of the rolling stock against the stamping die on the stamping pendulum.

The stamping pendulum 2, following a certain angular rotation of the pulse generator disk 11 when the projection 22 has moved out of the intermediate piece 21, causes the pulse raiser location O to act upon a control valve (FIG. 2). The cylinder space A' of the cylinder II is deaerated. Simultaneously, the standard pressure $P_2$ prevails in the cylinder space B'. The piston 18 retracts, with the cylinder II pulling the cylinder I with it.

Figure 3:
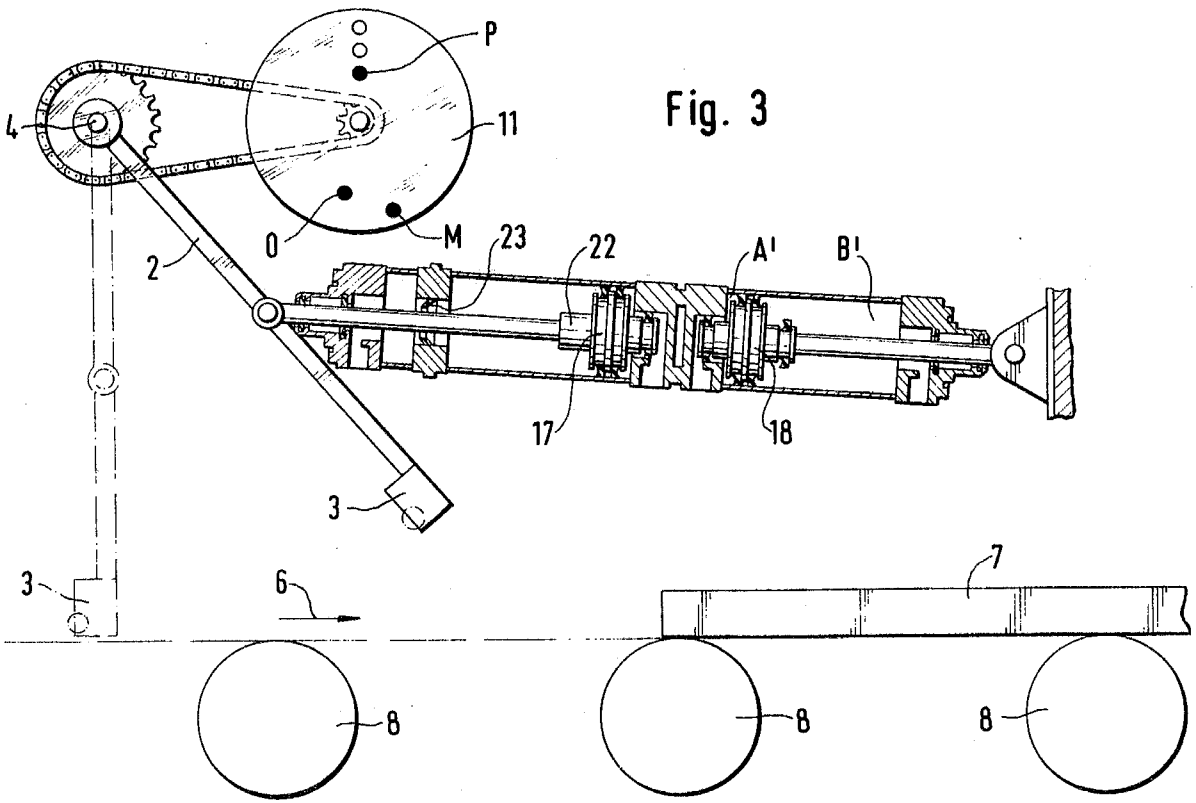
FIG. 3 is an illustration of the rotation of the stamping die out of the path of the advance of the rolling stock.

The pistons 17 and 18 are retracted as shown in FIG. 3. The stamping die has been rotated from the path of the advancing rolling stock into its highest position. The rolling stock is now able to pass under the stamping die. The pulse raiser location P of the pulse disk 11 is effective.

Figure 4:
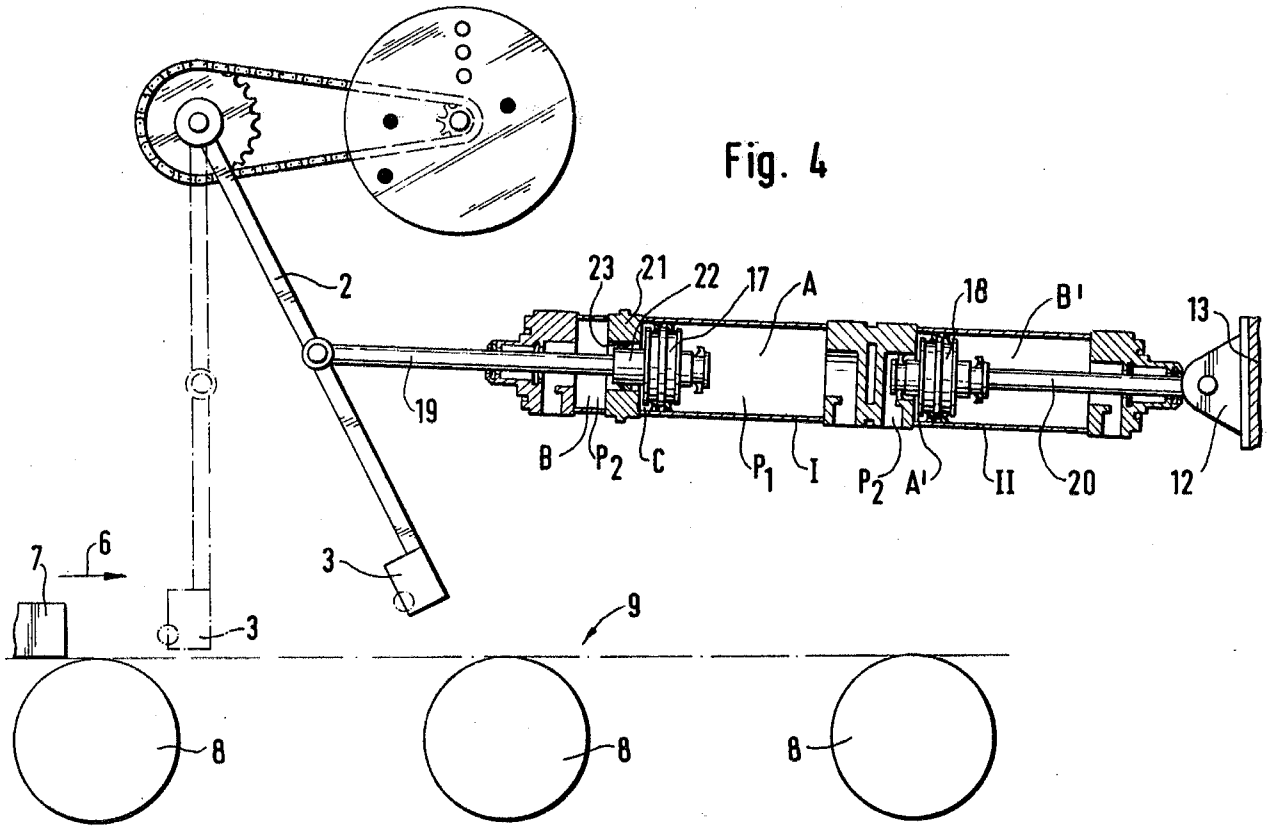
FIG. 4 shows the return of the installation into the standby position.

The cylinder space B is now deaerated. The piston 17, with the reduced pressure $P_1$ in its cylinder space A, moves into its initial position. The projection 22 therefore also moves into sealing engagement with the intermediate piece 21. The stamping pendulum correspondingly reduces the cylinder lift. The position of FIG. 4 is established. In this position, the cylinder space B' of the cylinder II is deaerated. The cylinder space A' is placed under the standard pressure so that the piston rod 20 extends. The stamping pendulum has attained its vertical position corresponding to the standby state.

The reduced pressure $P_1$ prevails in the cylinder space A of the cylinder I since the return motion and remains so. The cylinder space B is exposed to the standard pressure $P_2$. Standard pressure $P_2$ prevails in the cylinder space A' of the cylinder II.

The installation is ready for the next working cycle.

If the installation is used for rolling stock advancing at a velocity of less than 1.50 m/sec., the mode of operation is altered as follows:

According to FIG. 4, the piston rod 10 of the piston 17 is in the extended position. Reduced pressure $P_1$ prevails in the cylinder space A of the cylinder I, while the standard pressure $P_2$ prevails in the cylinder space B. The projection 22 is located in sealing engagement in the intermediate piece 21. The small cylinder space C between the piston 17 and the intermediate piece 21 is deaerated by means of a bore to the environment, i.e., to the atmosphere. The force $P_2$ acting in the direction of the piston 17, determined by the standard in the cylinder space B on the annular surface mentioned, is significantly smaller than the counteracting force $P_1$, which is determined by the reduced pressure $P_1$ and the surface area of the piston 17.

The standard pressure $P_2$ acts in the space B' on the piston 18 of the cylinder II and maintains the piston rod 20 in the retracted position.

The rolling stock 7 advances on the rolling train 9 with a given mass and velocity in the direction of the arrow 6 against the stamping pendulum and the stamping die 3. At a location determined as a function of the advance velocity of the rolling stock, the rolling stock itself actuates a control valve with a pulse to expose the piston 18 in the cylinder space A' to the standard pressure $P_2$. The cylinder space B' is deaerated. Compressed air at the standard pressure $P_2$ enters the cylinder space A', whereupon the piston rod 20 extends, with the result that because of the subsequent displacement of the united cylinders I and II against the point of attack on the pendulum, the rotating motion of the stamping die against the rolling stock receives additional support, and the kinetic force of the stamping die is increased during the rotation.

In free fall and supported by the extension of the piston rod 20, the stamping die executes a counter stroke at a predetermined point in time, i.e., at the arrival of the stamping pendulum in the vertical position and the impact of the rolling stock against the stamping die, so that the rolling stock is stamped in spite of the low advance velocity of said rolling stock.

Immediately upon stamping, the rolling stock moves the stamping pendulum into its return swing from the vertical position around the axis 4. The return swing motion initiated in this manner, as in the case of stamping of rolling stock advancing at a higher velocity, the piston rods 19 of the piston 17 are pushed or urged by the stamping pendulum into the cylinder I by means of a positive transmission of motion. The working cycle described above for this case is repeated.

While one embodiment of the invention has been described, it will be understood that it is capable of many further modifications and this application is intended to cover any variations, uses, or adaptions of the invention and including such departures from the present disclosure as come within knowledge or customary practice in the art to which the invention pertains, and as may be applied to the essential features hereinbefore set forth and fall within the scope of the invention or the limits of the appended claims.

I claim:

1. A device for stamping with a die workpieces which advance along a path, the device utilizing a source of compressed air including sources of both normal and reduced pressures the device comprising:

(a) a pendulum arm for carrying the die adjacent one end thereof;

(b) a cylinder arrangement including a cylinder, a piston having one side and another side, and a piston rod coupled with said piston and extending from said other side thereof, said pendulum arm being swingable by said piston rod between an operating position in which the die will be in the path of an advancing workpiece and a non-operating position in which the die will be out of the path of the advancing workpiece, said piston rod being in a run out position when said pendulum is in said operating position, said piston being in a run out position when said pendulum is in said non-operating position;

(c) an intermediate piece defining chambers on either side of said intermediate piece, one chamber being disposed generally to said one side of said piston when said pendulum is in the operating position and being disposed to one side of said intermediate piece; the other chamber being disposed to the other side of said intermediate piece;

(d) means for effecting communication between said one chamber and the source of reduced pressure;

(e) means for establishing communication between said other chamber and the source of normal pressure;

(f) a projection on said other side of said piston;

(g) a passage through said intermediate piece, said passage and said projection being arranged and configured for mutual sealing cooperation to block said passage when said piston rod is in said run out position and to selectively establish communication between said other chamber and a part of said one chamber on said other side of said piston when said projection and said passage are out of sealing cooperation, whereby a counterforce resulting from the reduced pressure acting on said piston exceeds a pendulum withdrawing force resulting from the normal pressure acting on said shoulder member when said projection and said passage are in sealing cooperation with each other and the pendulum withdrawing force exceeds the counterforce when the projection and passage are out of sealing cooperation.

2. A device according to claim 1 wherein said cylinder arrangement is a first cylinder arrangement and said cylinder is a first cylinder, the device further comprising:

(a) a second cylinder arrangement including a second cylinder, a second piston in said second cylinder, and a second piston rod coupled with said second piston, said second piston partially defining a pair of second cylinder chambers on either side thereof, said first and second cylinders being axially aligned and connected together at a connection region, said second cylinder having one closed end adjacent said connection region and facing toward said first cylinder and another end facing away from said connection region, said second piston rod protruding from said other end of said second cylinder, said second piston rod including means for effecting a pivotal connection by which said first and second connected cylinder arrangements are pivotally anchored in place, and (b) means for alternately introducing normal pressure from the source of normal pressure into, respectively, each cylinder of the pair of second cylinder chambers.

* * * * *